US008464972B2

(12) United States Patent
Nye et al.

(10) Patent No.: US 8,464,972 B2
(45) Date of Patent: Jun. 18, 2013

(54) CONCRETE PULVERIZER

(75) Inventors: Mark Nye, Mississauga (CA); John Charles Nye, Mississauga (CA)

(73) Assignee: Nye Manufacturing, Ltd., Mississauga (CA)

( * ) Notice: Subject to any disclaimer, the term of this patent is extended or adjusted under 35 U.S.C. 154(b) by 331 days.

(21) Appl. No.: 12/861,006

(22) Filed: Aug. 23, 2010

(65) Prior Publication Data

US 2011/0297773 A1 Dec. 8, 2011

(30) Foreign Application Priority Data

Jun. 2, 2010 (CA) ..... 2706174

(51) Int. Cl.
*B02C 1/06* (2006.01)

(52) U.S. Cl.
USPC ..... 241/101.73; 241/266

(58) Field of Classification Search
USPC ..... 241/101.73, 266–269
See application file for complete search history.

(56) References Cited

U.S. PATENT DOCUMENTS

| | | | |
|---|---|---|---|
| 4,776,524 | A | 10/1988 | Sakato |
| 5,292,079 | A | 3/1994 | Zakohji |
| 5,301,882 | A | 4/1994 | Morikawa et al. |
| 5,743,476 | A | 4/1998 | Morikawa et al. |
| 6,015,108 | A | 1/2000 | Okumura et al. |
| 6,119,970 | A | 9/2000 | Labounty et al. |
| 6,129,298 | A | 10/2000 | Nye |
| 7,306,177 | B2 | 12/2007 | Ward |
| 2007/0145171 | A1 | 6/2007 | Rafn et al. |

*Primary Examiner* — Mark Rosenbaum
(74) *Attorney, Agent, or Firm* — Gifford, Krass, Sprinkle, Anderson & Citkowski, P.C.

(57) ABSTRACT

A concrete pulverizer adapted for mounting on an arm of an excavator including a lower jaw having a first pivot pin mechanism and a crushing surface. The crushing surface on this jaw is formed with concrete waste apertures. An upper jaw has a rear end section connectible to an end of the arm and has crushing teeth mounted on a lower side. This jaw is pivotably connected to the lower jaw by the pivot pin mechanism. The upper jaw is pivotably connected to a hydraulic cylinder actuator on the arm and can be pivoted between an upper position and a crushing closed position. There is a power mechanism for pivoting the lower jaw between a horizontal scooping position and a dumping position and this mechanism can hold the lower jaw in a crushing position while the upper jaw is being pivoted by the hydraulic cylinder actuator.

15 Claims, 7 Drawing Sheets

CONCRETE PULVERIZER

PRIOR APPLICATION

This application claims priority on the basis of a Canadian Patent Application Number 2,706,174 filed Jun. 2, 2010.

This invention relates to concrete pulverizers for breaking pieces of concrete such as those found at a demolition site and particularly concrete pulverizers adapted for mounting on the end of the arm of a power excavator and this invention further relates to concrete handling machines for picking up and breaking pieces of concrete.

BACKGROUND OF THE INVENTION

The demolition of concrete structures and highway reconstruction can present significant problems in the disposal of large pieces of concrete including reinforced concrete and concrete paving. For example the disposal of large concrete slabs and large reinforced concrete structures can be difficult. One solution to the disposal of such concrete pieces is the use of a crusher or pulverizer which can break large concrete pieces into smaller particle sizes and chunks. By breaking the concrete up, one may be able to reuse the concrete as fill or as an aggregate base for roadways and other construction sites.

Concrete processors used for demolition can be broken into two broad categories of crushing equipment. The first category consists of primary processors which can be good for the demolition of concrete and precast structures. These processors which are designed for controlled demolition are able to deliver force to a small surface area using high pressure which results in clean, precise cracks. Such processors can also be used as a secondary concrete crusher for recycling. The second category of concrete processors is mainly used for secondary breaking of reinforced concrete. These processors can break concrete into further fines for recycling and they can be used to separate concrete from rebar. Such processors are able to deliver force over multiple points and this process causes the concrete to crumble. These processors can be attached to the dipper arm of a power excavator as an attachment which replaces the usual bucket used for digging.

A particular form of concrete pulverizer that can be referred to as a mechanical pulverizer is adapted for attachment to the outer or front end of the dipper arm of an excavator and this pulverizer uses the existing bucket cylinder mounted on the dipper arm to pulverize or crush the concrete piece by means of a jaw or tool connected to the hydraulic cylinder actuator. An advantage of a pulverizer of this type is that it is faster to operate and it can be less expensive than a hydraulically operated pulverizer that employs its own hydraulic cylinder or cylinders for the pulverizing operation.

One known form of mechanical pulverizer is taught in U.S. Pat. No. 6,129,298 issued Oct. 10, 2000 to National Attachments, Inc. This known pulverizer is mounted on the outer end of the dipper arm of an excavator and it includes two jaws confronting and closing on one another and an independent ripper-shank with a ripper tooth. Each jaw includes teeth that serve to engage and fracture concrete slabs. One of the jaws can be pivoted by the large hydraulic cylinder actuator mounted on the front side of the dipper arm or dipper stick. The pulverizer/ripper unit is pivotably attached at 3 points at the end of the dipper stick. Each of the two jaw sections includes multiple projections in the form of upper and lower teeth with a working gap located these two sets of teeth.

There is a need for an improved mechanical-type pulverizer that is better able to pickup chunks of concrete and that is better able to position each large chunk closer to the pivot axis of the jaws of the pulverizer so that a better crushing force can be applied to the concrete piece.

SUMMARY OF THE PRESENT DISCLOSURE

According to one embodiment of the present invention, a concrete pulverizer is adapted for mounting on an outer end of a dipper arm of a power excavator, this dipper arm having a hydraulic cylinder actuator mounted on a front side of the dipper arm. The pulverizer includes a movable lower jaw having a pivot pin mechanism and a crushing surface on which a concrete piece can be received. The crushing surface is formed with concrete waste apertures. A set of forwardly projecting teeth are mounted along a front edge of the lower jar. The pulverizer also has a movable upper jaw having a rear end section adapted for connection to the outer end of the dipper arm and having crushing teeth mounted on a lower side of the upper jaw. This upper jaw is pivotably connected to the lower jaw by the pivot pin mechanism. A further pivot arrangement is provided to pivotably connect the upper jaw to the hydraulic cylinder actuator whereby the upper jaw can be pivoted from an upper open position to a crushing closed position by the hydraulic cylinder actuator. The crushing teeth lie adjacent to the crushing surface in the closed position of the upper jaw. The pulverizer also has a power mechanism for pivoting the lower jaw between a horizontally extending scooping position for picking up the concrete pieces and a dumping position. This power mechanism is adapted to hold the lower jaw in a crushing position while the upper jaw is being pivoted by the hydraulic cylinder actuator for a concrete crushing operation.

In an exemplary version of this pulverizer, the power mechanism is a second hydraulic cylinder actuator connected at one operating end thereof to the lower jaw and connectable at an opposite end of the actuator to a side of the dipper arm.

According to another embodiment of the invention, a concrete pulverizer for breaking pieces of concrete is adapted for mounting on an outer end of a dipper arm of a power excavator, this dipper arm having a hydraulic cylinder actuator mounted on a front side of the arm. The pulverizer includes a movable lower jaw forming a crushing upper surface on which a concrete piece can be received, having a front edge on which a set of teeth are mounted, and having a rearwardly extending, elongate arm rigidly connected to the lower jaw and adapted for orienting the lower jaw. There is also a movable upper jaw having a first pivot mechanism for pivotably connecting a rear end section of the upper jaw to the outer end of the dipper arm, having a mechanism for crushing the concrete piece between the upper jaw and the upper surface of the lower jaw, and having a second pivot mechanism for pivotably connecting the upper jaw to the hydraulic cylinder actuator whereby the upper jaw can be pivoted from an upper opened position to a closed position by the hydraulic cylinder actuator. The crushing mechanism lies adjacent the crushing upper surface in the closed position of the upper jaw. There is a further hydraulic power device connectable to a rear end section of the rearwardly extending arm in order to pivot the lower jaw to a plurality of desired operating positions. During use of the pulverizer on a dipper arm, the lower jaw can be pivoted to a horizontally extending operating position in order to scoop up one or more concrete pieces to be crushed.

In an exemplary version of this pulverizer, the hydraulic power mechanism is a second hydraulic cylinder actuator comprising a hydraulic cylinder and an extendable actuator rod. The hydraulic cylinder is connectable at an upper closed end thereof to a rear side of the dipper arm while the actuator rod is pivotably connectable to the rear end section of the elongate arm. According to yet another embodiment of the invention, a concrete pulverizer for mounting on a movable arm of a power excavator is provided. The arm of the excavator has an extendable hydraulic cylinder actuator mounted on a front side thereof. The pulverizer includes an upper jaw having a rear end section pivotably connectable to one end of the arm and having a front end. The upper jaw is adapted for connection to the hydraulic cylinder actuator for pivotal movement thereby. A first row of forwardly extending pickup teeth are mounted on the front end of the upper jaw. A lower jaw has a rear portion connected to the rear end section of the upper jaw for pivotal movement about a primary pivot axis. The lower jaw forms a crushing surface on an upper side thereof on which a concrete piece can be received and the lower jaw has a front edge. A second row of forwardly extending pickup teeth are mounted on this front edge. There is also an actuator mechanism adapted for mounting on the arm and for connection to the lower jaw, this mechanism during use of a pulverizer being capable of pivoting the lower jaw about the primary pivot axis and between a horizontally extending concrete scooping position and a dumping position. The two rows of pickup teeth are approximately the same perpendicular distance from the primary pivot axis. During use of the pulverizer, the two jaws can be pivoted towards each other to a pickup position where front tips of the teeth in one of the rows are closely adjacent front tips of the teeth in the other of the rows.

While a preferred embodiment is disclosed herein, this is not intended to be limiting. Rather, the general principles set forth herein are considered to be illustrative of the scope of the present invention and it is to be understood that numerous changes may be made without straying from the scope of the present invention.

BRIEF DESCRIPTION OF THE DRAWINGS

An exemplary embodiment of the invention will be described in detail below with reference to the drawings, wherein.

DETAILED DESCRIPTION OF EXEMPLARY EMBODIMENT

Figure 1:
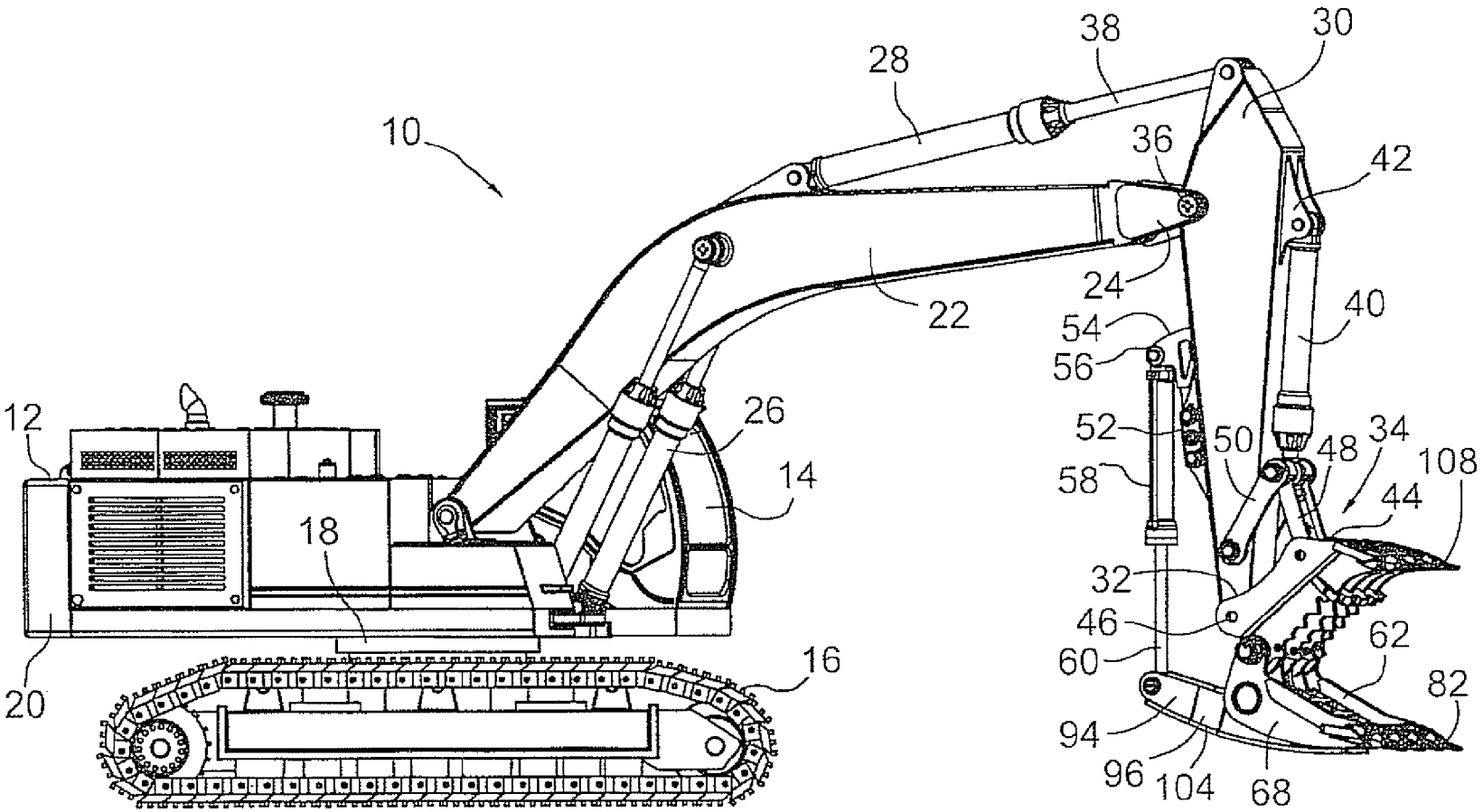
FIG. 1 is a perspective view of a concrete handling machine for picking up and breaking pieces of concrete, the main portion of the machine comprising a mobile construction machine shown from one longitudinal side.

Referring to FIG. 1, there is shown a concrete handling machine indicated generally at 10 capable of picking up and breaking pieces of concrete (not shown). This machine includes a mobile construction machine 12 adapted to carry a machine operator in an operator cab 14. It will be understood that the mobile construction machine can be of known construction and can be the same as those commonly available for power excavators having a backhoe type digging attachment with a bucket. The illustrated construction machine is mounted on a standard set of tracks 16 and it will be understood that there are two tracks that support a central pivot support 18 on which an upper portion 20 of the machine is able to pivot about a vertical axis. An elongate boom or boom structure 22 is mounted on the upper portion of the construction machine and tiltably extends there from to a front end 24 of the boom. The boom is able to be raised or lowered by means of two hydraulic cylinder actuators 26, one on each side of the boom. The rear end of the boom is pivotably mounted to the upper portion of the machine as shown. Mounted on top of the boom is a further hydraulic cylinder actuator 28 which can be of standard construction. Pivotally mounted on the front end of the boom is an elongate dipper arm 30 which can also be termed a dipper stick and which is commonly found in a standard power excavator. The dipper arm has a lower or forward end at 32 on which is mounted a concrete pulverizing attachment constructed in accordance with the present invention, this pulverizing attachment pulverizer indicated generally at 34. The dipper arm or dipper stick is pivotally mounted at 36 to the boom and it will be understood that the hydraulic cylinder actuator 28 is capable of pivoting the swinging arm about a substantially horizontal axis located at 36. In particular a rod 38 of the actuator has its outer end pivotably connected to the top or rear end of the dipper arm.

Pivotally mounted on the swing arm is an additional hydraulic cylinder actuator 40 which can be pivotably attached to the dipper arm by a pair of brackets 42. The actuator 40 is provided for the purpose of enabling an upper jaw 44 of the pulverizing attachment to be pivoted about a substantially horizontal pivot axis at 46. It will be understood that a single pivot pin can be provided at 46 to connect a rear end section of the upper jaw to the forward end 32 of the swing arm. When the mobile construction machine 12 of FIG. 1 is not fitted with the concrete pulverizing attachment or pulverizer 34, it can be fitted with a standard digging bucket (not shown) and, in this case, the actuator 40 can be used to operate the digging bucket in a normal fashion.

As illustrated, the extendable rod of the actuator 40 is pivotably connected to two pairs of links indicated at 48 and 50 which again can be of standard construction and are commonly used on the boom of an excavator. The pair of links 50 pivotably connect the outer end of the actuator rod to a front end section of the dipper stick 30 while the pair of links 48 pivotably connect the outer end of the rod to the upper jaw 44. Also mounted on the bottom or rear surface of the dipper stick is a three-hole bracket 52 shown separately in FIG. 10. This bracket can be welded on one side to the dipper stick and it is used to adjustably connect an adapter 54 described in more detail hereinafter and shown in FIG. 9. Pivotably connected to this adapter by means of a pivot pin 56 is an additional hydraulic cylinder actuator 58 which acts as a hydraulic brace for the concrete pulverizer as explained later herein. This actuator has an extendable rod 60 and, with this rod, the actuator is able to control the orientation of a lower jaw 62 of the pulverizer.

Figure 2:
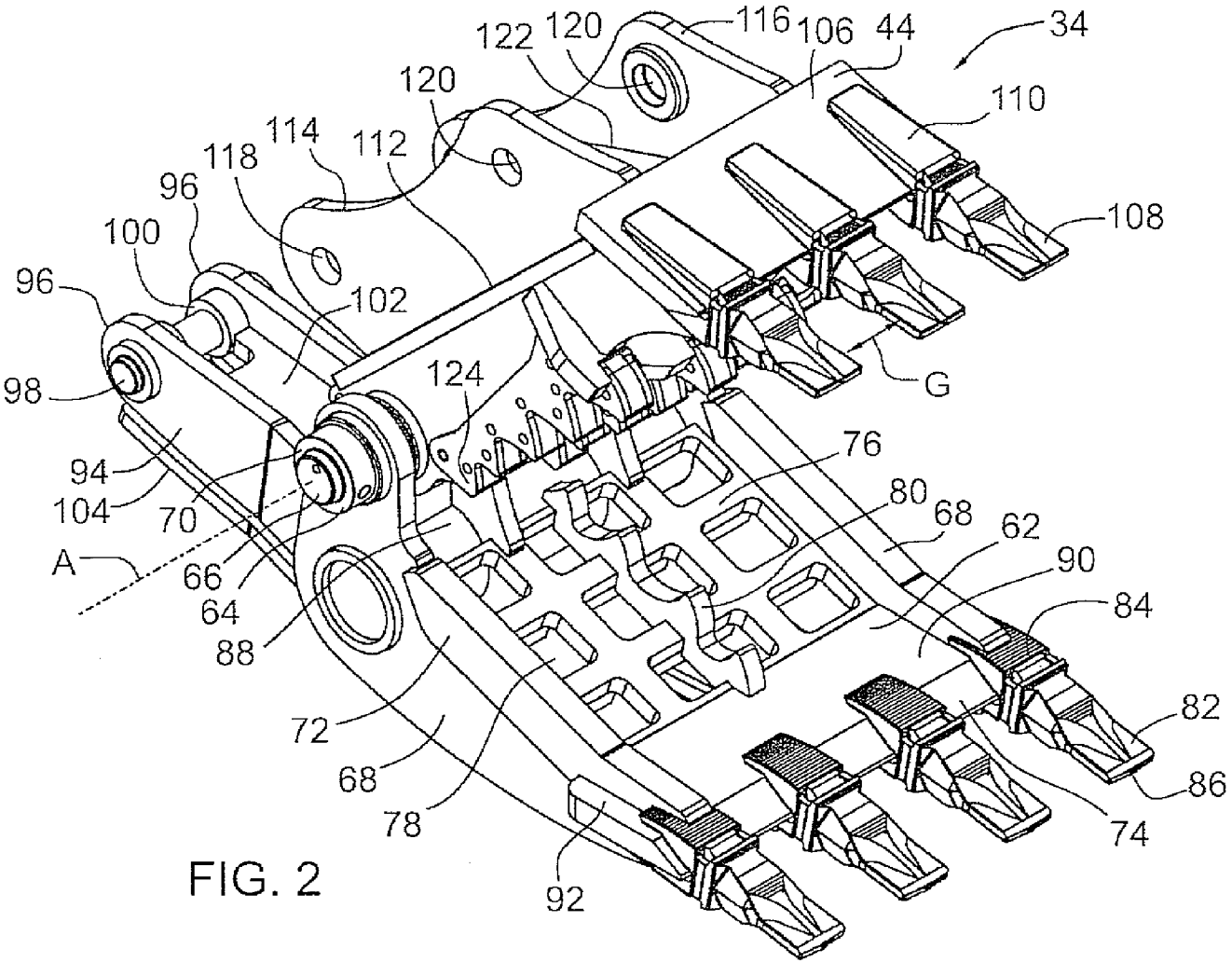
FIG. 2 is a perspective view of the concrete pulverizer used on the concrete handling machine of FIG. 1, the pulverizer being shown from above and from the front.

Turning now to FIG. 2 which illustrates an exemplary version of the concrete pulverizer 34, its lower movable jaw has a pivot pin mechanism indicated generally at 64. The upper jaw 44 is pivotably connected to the lower jaw by this pivot pin mechanism. The pivot mechanism can include a single pivot pin 66 extending through holes in upwardly extending legs of L-shaped side plates 68. Each pin can extend through a bushing 70 that is mounted in the side plate 68. An elongate wear rail 72 can be rigidly attached to the plate 68 along the top of its forwardly extending arm. These wear rails which can be made of hardened, wear resistant steel extend substantially perpendicular to a front edge 74 of the lower jaw. The lower jaw includes a steel grate (which can also be termed a grizzly plate) in which concrete waste apertures 78 are formed. These apertures can be arranged in a plurality of rows as shown and, in the illustrated embodiment, the grate has three rows extending in the transverse direction and three or four rows extending in the front to rear direction. The steel grate forms a crushing upper surface of the lower jaw on which a concrete piece can be received initially and then crushed. If desired, an optional row of crushing teeth can be provided in the middle of the grate 76 as shown. These teeth can be formed from a single steel plate which can be mounted in a vertical plane and can extend in the rear to front direction on the lower jaw. The crushing teeth 80 can be shaped in the same manner as crushing teeth mounted on the upper jaw which are described hereinafter. The plate forming the teeth 80 can be welded to the grate 76.

A set of forwardly projecting teeth 82, which can be described as pickup teeth, are mounted along the front edge 74 of the lower jaw. The teeth 82 in an exemplary version of the pulverizer are detachable teeth so that they can be readily replaced. The base of each tooth fits into a respective tooth socket 84 formed on the front edge of the jaw. The teeth are preferably spaced apart as shown and can be spaced apart a distance equal to the width of one tooth. The teeth, which are made of hardened steel, can have a straight, front edge 86 so that the teeth as a whole are suitable for scooping up heavy objects such as chunks of concrete. In other words the flat front edges are suitable for insertion between the ground or floor and the concrete piece or slab. It will be appreciated that by a forward movement of the pulverizer (with the jaws in the open position) using the dipper stick of the excavator machine even a large concrete piece can be scooped into the pulverizer so that it rests on the steel grate 76.

Other features of the exemplary lower jaw shown include a relatively large, connecting tube 88, the ends of which can be inserted through circular holes formed in each of the side plates 68 and these ends can be welded in the holes thereby forming a rigid connection between the two side plates. Also extending between the two side plates is a solid, generally rectangular front connecting plate 90 which can be tapered along its forward edge to form the front edge 74. Side edge sections of the plate 90 can extend through respective slots formed at front end sections of the side plates 68. As shown, each side edge 92 of the connecting plate can project a short distance beyond the outer side of the adjacent side plate 68.

An exemplary version of the lower jaw 62 is provided with an elongate, rearwardly extending arm 94 which can be formed of two spaced-apart, parallel arm plates 96. The outer end of the rod 60 is pivotably connected to a rear end section of the arm 94 by means of a pivot pin 98. The pin hole in each plate 96 can be extended by means of a short sleeve member 100, thereby providing a stronger connection between the pin and the arm. The two arm plates 96 can be rigidly connected to each other by means of a suitable connecting plate 102. Also, an exemplary form of the arm has elongate wear bars 104 rigidly attached to the bottom edge of the arm plates 96.

Figure 7:
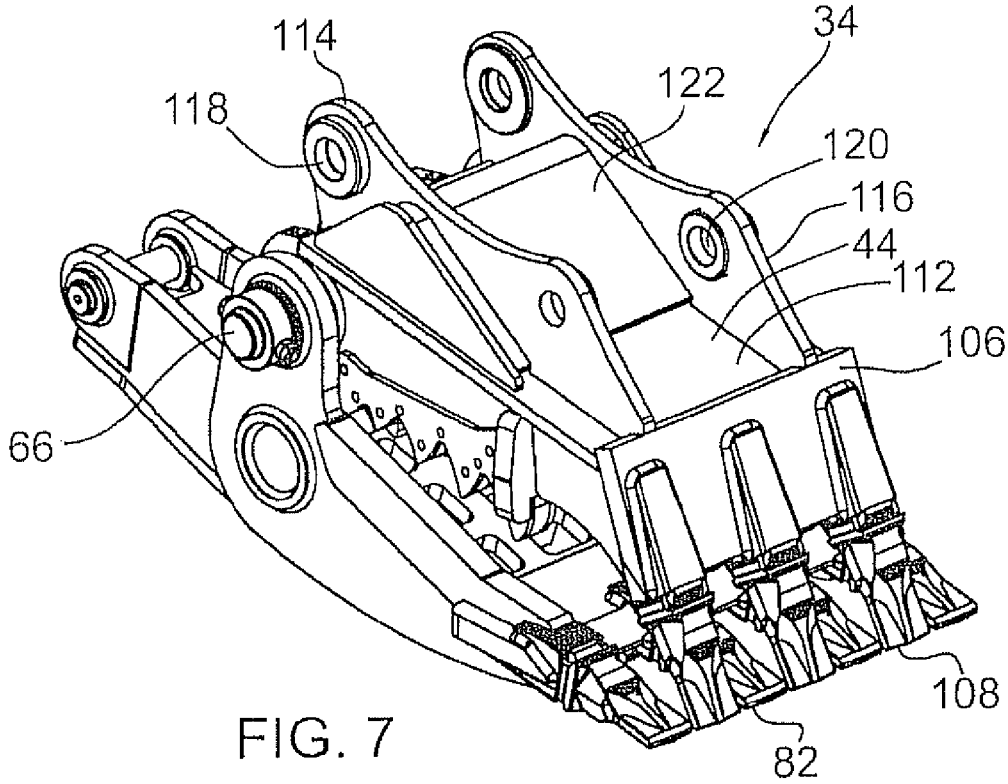
FIG. 7 is a perspective view of the concrete pulverizer showing its upper and lower pick-up teeth in a tip-to-tip position.
Figure 8:
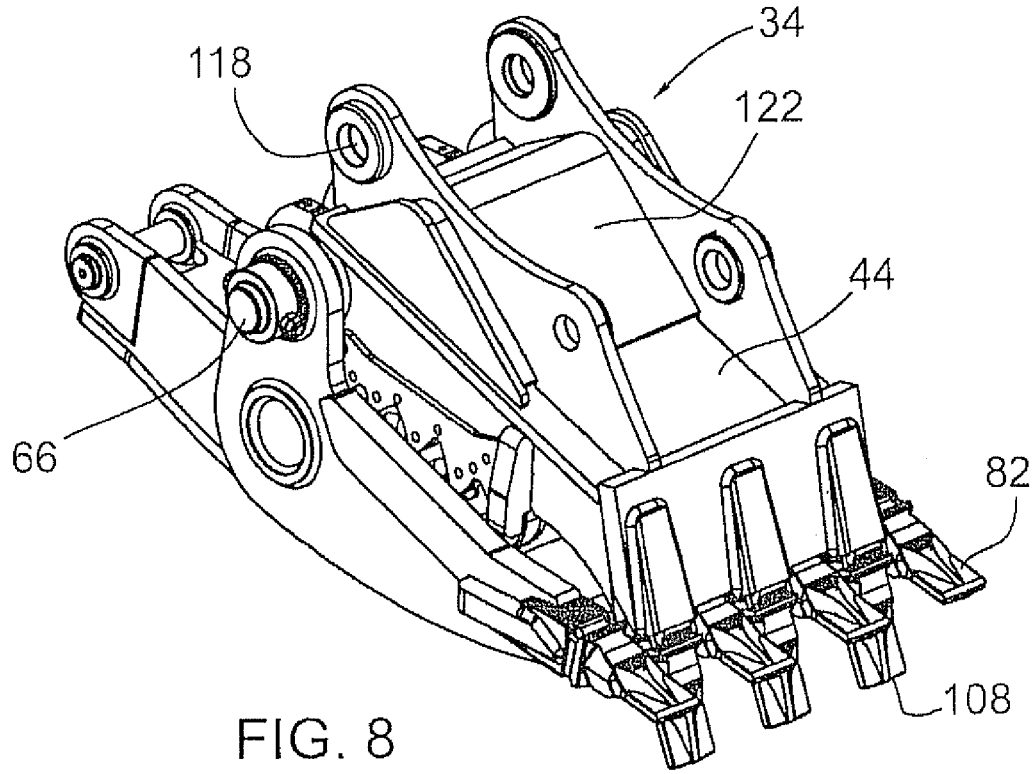
FIG. 8 is a perspective view of the pulverizer of FIG. 7 but showing its upper and lower pick-up teeth in a fully meshed position.

Turning now to the construction of the upper jaw 44, a forward section of the jaw is formed by a rectangular, sloping front plate 106 and a front edge of this plate forms a front edge of the upper jaw to which a set of forwardly projecting pickup teeth 108 are connected. Each tooth 108 can be constructed and mounted in a similar manner as the teeth 82 on the lower jaw. Again the teeth 108 are detachable in an exemplary version of the pulverizer in order that they can be replaced from time to time as they become broken or worn. The base of each tooth is mounted in a tooth socket 110 which in turn is mounted in or on the plate 106. As shown, the teeth 108 are spaced apart from one another and, in the exemplary arrangement, the gap between adjacent teeth is slightly greater than the width of each tooth 82. It will be appreciated from FIGS. 1, 2 and 7 that the two rows of pickup teeth, that is the row of teeth 82 and the row of teeth 108 are approximately the same perpendicular distance from the primary pivot axis indicated at A and defined by the pivot pin 66. During use of the pulverizer, the two jaws can be pivoted towards each other to a pickup position shown in FIG. 7 where the front tips of the teeth in one of the rows are closely adjacent the front tips of the teeth in the other of the rows. Thus the present pulverizer is a very good power tool for picking up large pieces of concrete and concrete slabs either to move them to a different location or in order to carry out a crushing operation. Moreover, because of the spacing of the pickup teeth, the set of teeth mounted in one row can mesh with the second set of teeth mounted on the other jaw when the two jaws are pivoted relative to one another to a fully closed position, this position being shown in FIG. 8.

The upper jaw also has a steel, rectangular base plate 112 which is attached, such as by welding along its front edge to the front plate 106. Extending upwardly from the plate 112 are two, spaced apart connecting plates 114 and 116. Through each of these plates extend two pivot pin holes 118 and 120. The rearward holes 118 are used to connect a rear end section of the jaw to the outer or bottom end of the dipper arm 30. A single pivot pin defines the aforementioned pivot axis at 46. The forward holes 120 accommodate a pivot pin that connects the upper jaw to the two links 48. To add to the rigidity of the upper jaw and its connecting plates, a steel connecting plate or bridge 122 extends between and connects the plates 114 and 116.

Figure 3:
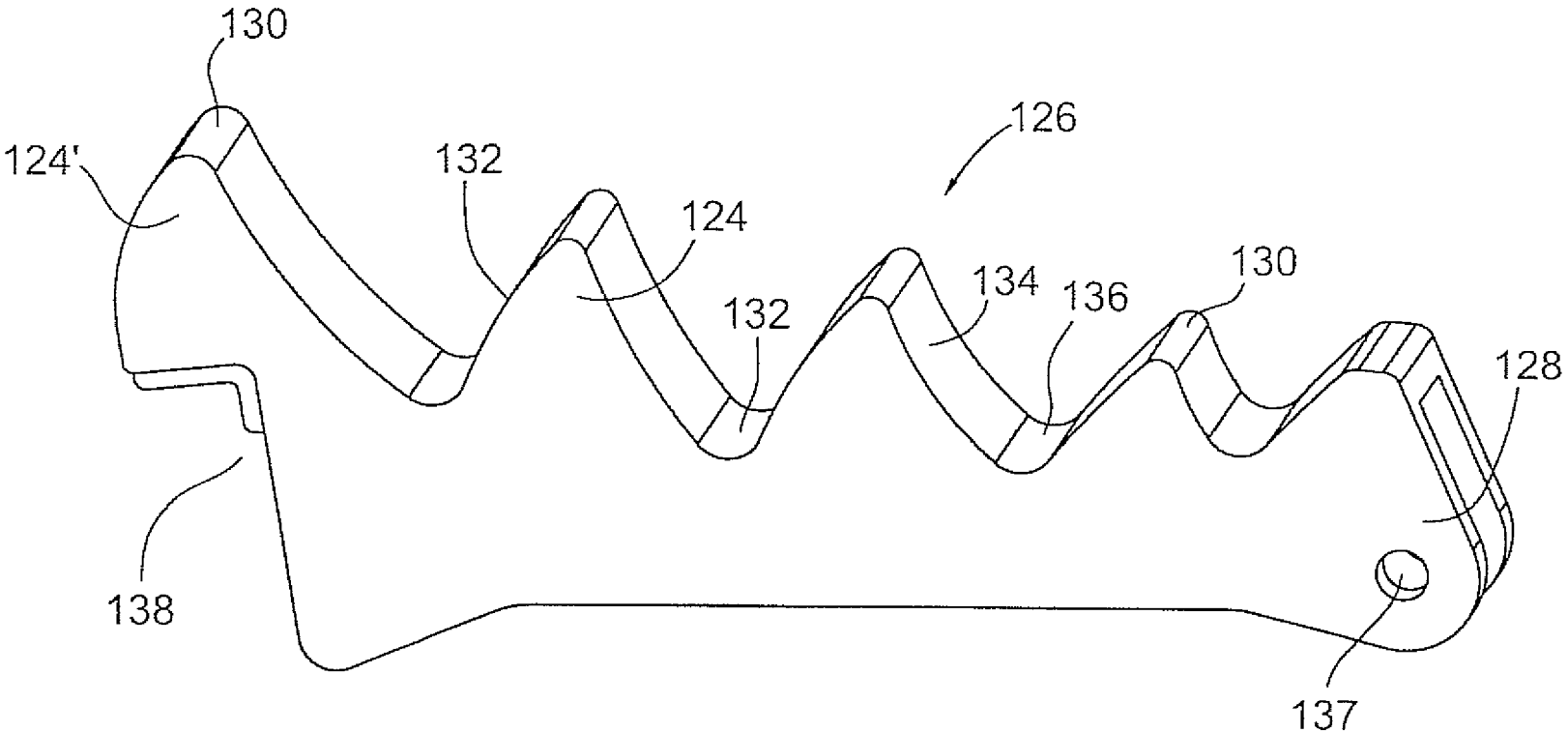
FIG. 3 is a detail view in perspective of a steel plate used to form a row of crushing teeth in the upper jaw of the pulverizer.

The upper jaw is provided with crushing teeth 124 which are mounted on a lower side of the upper jaw. In particular these teeth can be mounted on the inwardly facing or bottom side of the base plate 112. The crushing teeth 124 are formed by a series of parallel crushing teeth units 126, one of which is shown separately in FIGS. 3 and 5. These units are arranged in a side-by-side manner on the upper jaw. In the illustrated crushing teeth unit 126 of FIG. 3 there are five teeth 124 of varying height. The forwardmost tooth 124' has the greatest height while the two teeth located at the rearward end 128 of the plate have the smallest height. These crushing teeth have rounded tips 130 and each tooth has a convex front surface 132 and a concave rear surface 134. The front and rear surfaces meet at the rounded tip 130. The bottom section 136 located between adjacent teeth can also form a concave surface. By providing the highest crushing teeth along the front of the upper jaw, they are able to assist in the initial grasping of the concrete piece or slab. The curvature of the crushing teeth also helps to pull the concrete piece or slab to the rear of the jaws where the greatest crushing pressure can be applied. The units 126 forming the crushing teeth are mounted in the upper jaw by using a pin and retainer system indicated generally in FIG. 5 by reference 140 and support pockets and these plates can be replaced readily when required. The rear hole 137 for the pin is shown in FIG. 3. The forward end of each unit 126 can be formed with a right angled cutout 138.

Figure 4:
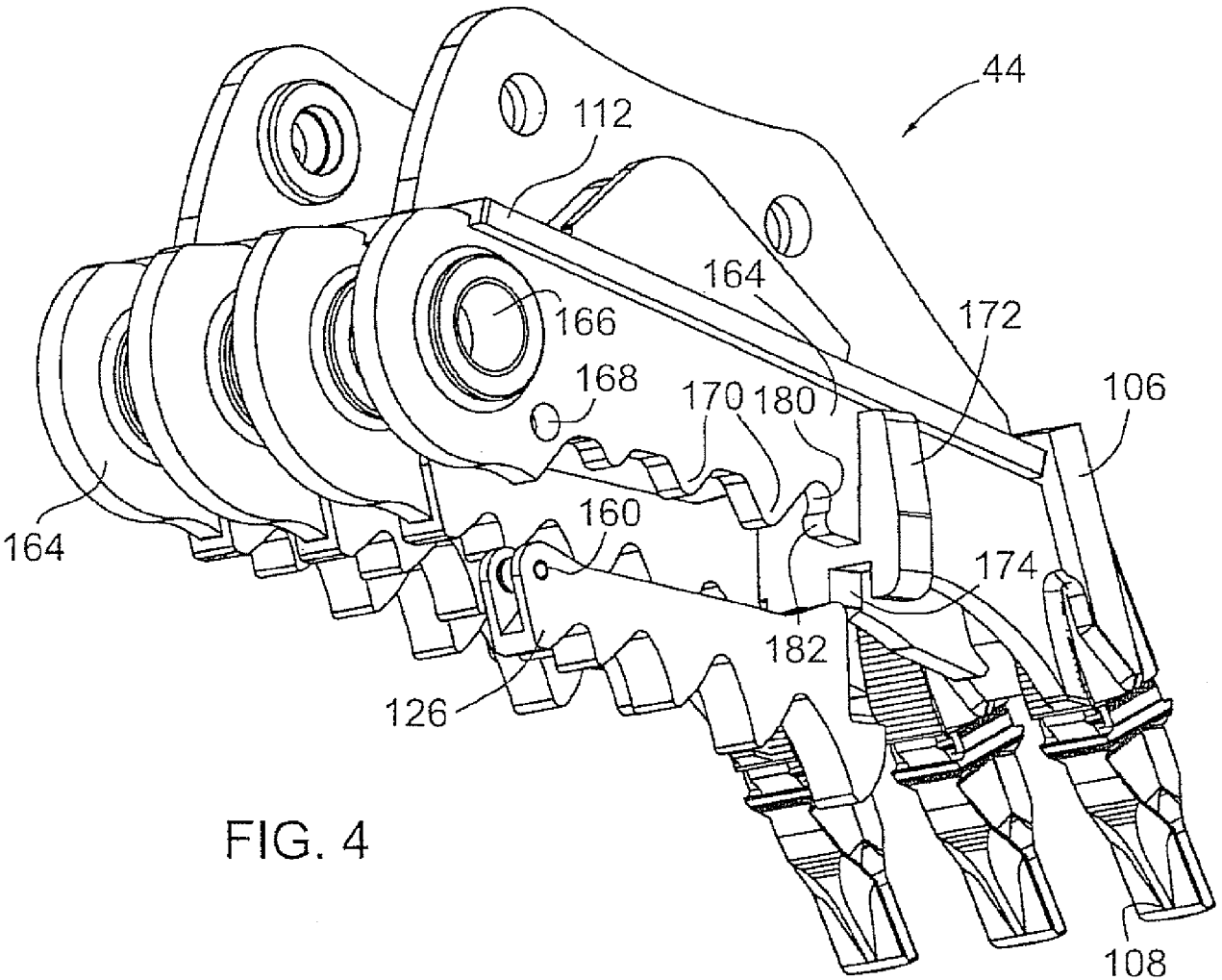
FIG. 4 is a perspective view of the upper jaw of the pulverizer, this view being taken from the rear end and from below and showing a separated crushing teeth unit.
Figure 5:
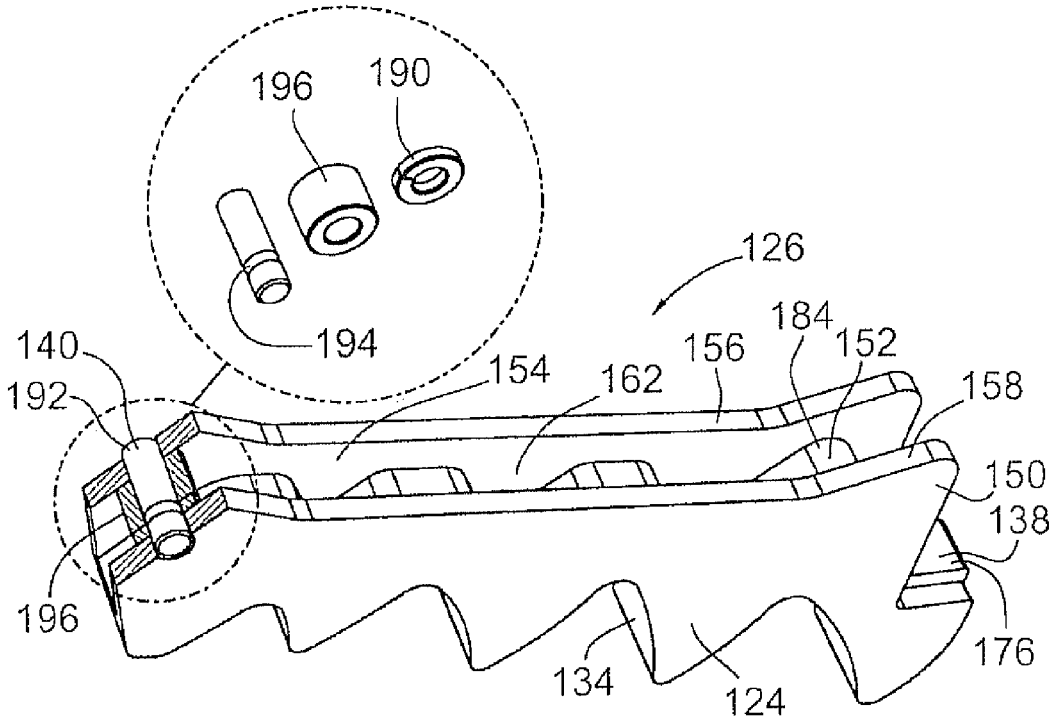
FIG. 5 is a detail view of in perspective of the circled crushing teeth unit shown in FIG. 4, this view showing the top side and a longitudinal side thereof.
Figure 6:
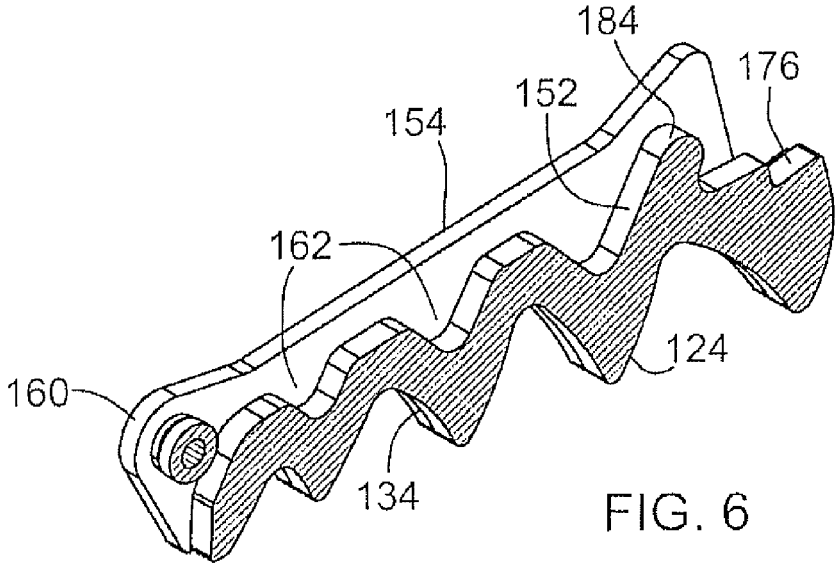
FIG. 6 is a detail vertical cross-section of one half of the crushing teeth unit of FIG. 5, this view taken along a longitudinal centerline of the unit.

With reference to FIGS. 4 and 5, each crushing teeth unit 126 can be constructed from three steel plates that are welded together, these plates being indicated at 150, 152, and 154. The two outer plates 150 and 154 have the same size and shape and each is formed with the aforementioned cutout 138. The crushing teeth are formed along the bottom edge of each plate while the upper edges of the two outer plates have a straight central portion 156. Near the forward end there is an upwardly sloping section 158 while the rear end of each outer plate is rounded at the top as indicated at 160 in FIG. 4. The thicker central plate 152 has a bottom edge which is shaped to form crushing teeth in the same manner as the outer plates. The shape of the central plate 152 is shown clearly in FIG. 6. The upper surface of the plate 152 is formed with a number of cavities or pockets 162 which can vary in depth.

Each unit 126 is mounted on a rigid, vertically extending support plate 164 of which there are four shown in the embodiment of FIG. 4. Each of these plates is welded along a straight upper edge to the rectangular base plate 112 and each is formed with a pivot pin receiving hole 166 which can be lined with a suitable bushing. Near the hole 166 and slightly forward thereof is a smaller hole 168 which is used to mount a respective one of the crushing teeth units 126 on the plate 164. Formed along the bottom edge of each plate 164 are several, rounded holding teeth 170. These teeth extend into the aforementioned cavities 162 in the unit 126 and thus help to hold the unit 126 in place. A front edge of each plate 164 is welded to a nose plate 172. The nose plate has a series of spaced apart, square notches 174 formed in its bottom edge and each of these receives a protruding bottom section 176 of a respective unit 126. Formed near the front end of each plate 164 is a holding cavity 180 on one side of which is a rearwardly projecting lip 182. The central steel plate 152 is formed with an upwardly and forwardly extending projection at 184 which fits snugly into the cavity 180 and the combination of the projection 184 and the lip 182 is used to hold the front end of each unit 126 in place on the jaw.

In the circled area projected from FIG. 5 there is shown the three components which make up the pin and retainer system 140. These components include a lock washer 190, a short pin 192 formed with a circumferential groove 194 and a bushing 196. The pin extends through the bushing and the washer and the washer is pressed onto the pin so as to fit into the groove 194. Thus the washer acts as a retainer to hold the pin in place once the pin is used to mount the rear end of the unit 126. The pin and its bushing are accommodated in their respective hole 168. It will be thus be seen that each crushing teeth unit 126 is detachably connected to a respective one of the support plates 164 and thus each unit 126 can be replaced or repaired when required.

Instead of forming the unit 126 using three steel plates as in the illustrated embodiment, it is also possible to form the crushing teeth unit as an integral casting made of abrasion resistant steel and a unit of this type can be less expensive to manufacture in quantity.

The pulverizer 34 as illustrated is particularly suitable for separating reinforced rod (rebar) from concrete demolition debris. This is accomplished by an efficient crushing of large concrete pieces or slabs using the replaceable pulverizing teeth 124. As the concrete is crushed between the two jaws, smaller pieces of concrete can fall through the apertures 78. With the present front end loaded pulverizer, the large dipper arm 30 of the excavator acts as part of the pulverizing structure and is loaded by the pulverizing cycle.

It will be appreciated that the hydraulic cylinder actuator or hydraulic brace 58 is provided for adjusting the position or orientation of the lower jaw (which can also be termed a mandible) and this actuator is not normally used for crushing. The actuator 58 can be retracted to allow scooping from the ground level as the dipper arm 30 is cast out by the machine operator. The actuator 58 can be extended to allow scooping in close to the machine with the dipper arm located close to the machine. The actuator 58 or brace can be extended to help position the jaws in a more vertical position, thereby encouraging concrete pieces to fall in closer to the jaw pivot axis by gravity.

It will be noted that the crushing teeth in the upper jaw oppose a flat, strong steel grate mounted in the lower jaw. Concrete chunks positioned between the two jaws are pulverized by pressure applied by the crushing teeth which have staggered heights. Although smaller chunks of concrete can fall through the waste apertures 78 of the grate, the grate tends to prevent rebar from falling with these chunks and concrete dust, thereby helping in the effort to separate the rebar from the concrete.

When the pulverizer jaws are mounted in the manner shown in FIG. 1 to the dipper arm, the main mounting pins used to connect the rear end section of the upper jaw to the front end of the dipper arm are set at a wider centre distance to maximize the crushing forces produced by the cylinder actuator 40. It is also possible to connect the pulverizer to the dipper arm by means of known types of pin-grabber couplers and quick couplers that allow the operator to switch from the pulverizer to a regular bucket and vice versa reasonably quickly and reasonably easily.

Figure 9:
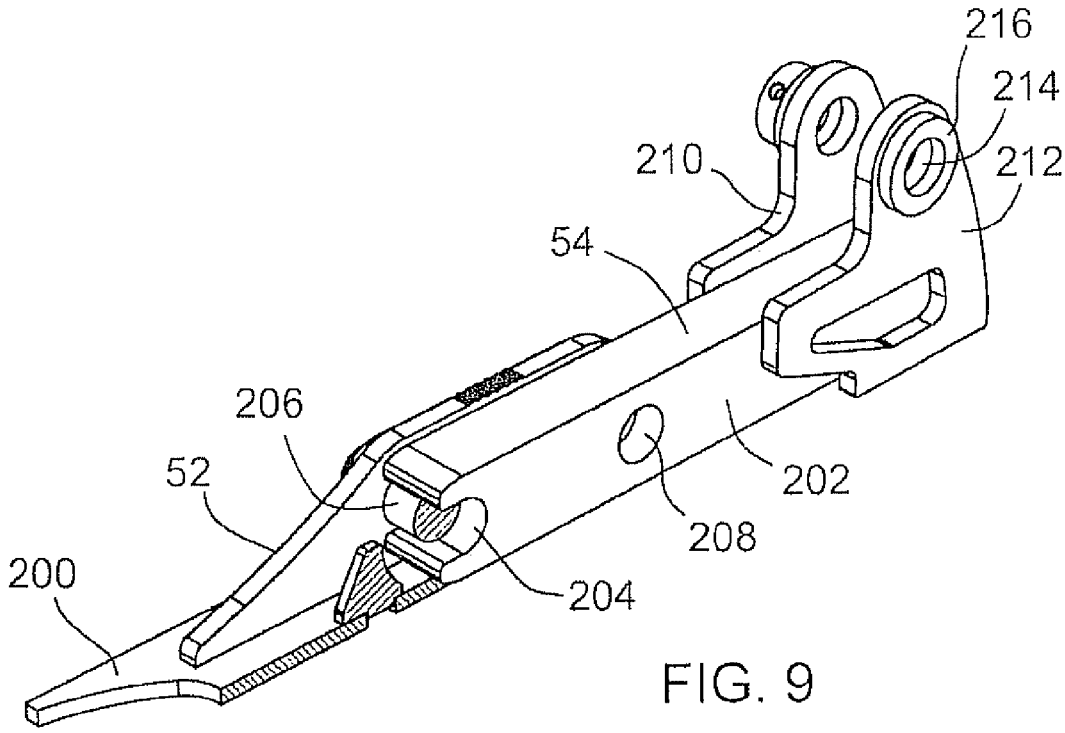
FIG. 9 is a perspective view of an adapter used to connect a hydraulic brace to the dipper arm of a power excavator and a three-hole bracket to which it can be attached, a portion of the bracket being shown in longitudinal cross-section.
Figure 10:
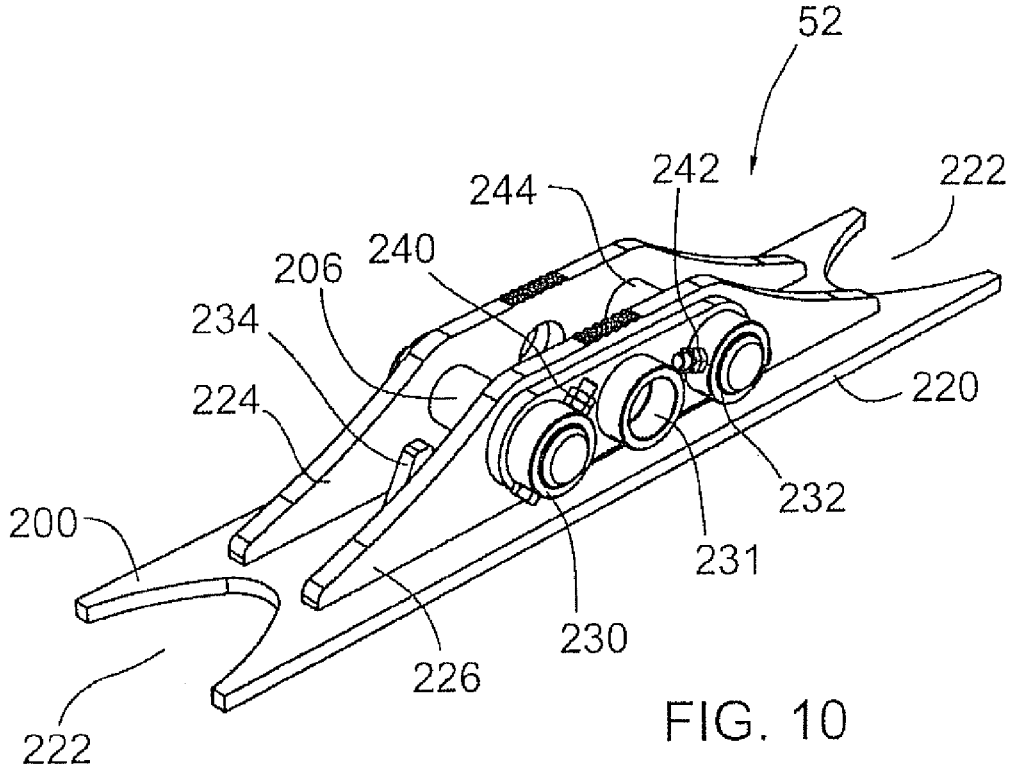
FIG. 10 is a perspective view of the three-hole bracket to which the adapter of FIG. 9 is connected.

The adapter 54 shown in FIGS. 1 and 9 allows the hydraulic cylinder actuator 58 to be used on an excavator that has been previously equipped with the known three hole bracket 52. The adapter is mounted with two pins to the existing three hole bracket welded to the underside of the arm. In the illustrated version of FIG. 10, a relatively large flat steel pad 200 can be provided to direct compressive forces up into the arm and thereby prevent the application of excessive torque on the three hole bracket.

The exemplary adapter 54 shown in FIG. 9 includes an elongate steel bar 202 of rectangular transverse cross-section. Located at a forward end of this bar is a semi-cylindrical recess 204 which is sized to fit around a connecting pin 206. Mid-way along the bar is pin receiving hole 208. Mounted on the rear end of the bar are two similar, spaced apart brackets 210, 212, each of which is welded to a respective side of the steel bar. A pivot pin hole 214 is formed in each bracket and the perimeter of the hole can be reinforced by an annular rim 216. The aforementioned pivot pin 56 extends through the holes 214 to attach the hydraulic cylinder actuator 58. Details of the three-hole bracket to which the adapter is detachably connected can be seen in FIG. 10. The base of the bracket device is the aforementioned steel pad 200 which has two parallel longitudinal sides 220 and, in the exemplary embodiment shown, has end recesses 222. Extending from the outer side of the pad are two bracket plates 224, 226 and these are spaced apart a distance sufficient to receive the aforementioned steel bar 202 of the adapter. Each bracket plate is formed with three pin receiving holes indicated at 230 to 232. If desired, a metal tongue or stop member 234 can extend upwardly between the bracket plates close to one end of these plates. The connecting pins which join the adapter to the three-hole bracket 52 can be secured in place by means of bolt and nut combinations 240, 242. The illustrated adapter of FIG. 9 is only connected to the three-hole bracket by means of two steel connecting pins 206 and 244. It will be appreciated that by using the adapter 54, the connecting pin 56 that extends through the adapter can be located further upwards on or rearwards on the dipper arm, thus allowing the use of a larger hydraulic brace.

While the present invention has been illustrated and described as embodied in an exemplary embodiment, e.g., an embodiment having particular utility in concrete pulverizing operations, it is to be understood that the present invention is not limited to the details shown herein, since it will be understood the various omissions, modifications, substitutions and changes in the forms and details in the disclosed concrete pulverizer and pulverizing machine may be made by those skilled in the art without departing in any way from the spirit and the scope of the present invention. For example, those of ordinary skill in the art will readily adapt the present disclosure for various other applications without departing from the spirit or scope of the present invention.

We claim:

1. A concrete pulverizing attachment adapted for mounting on an outer end of a dipper arm of a power excavator, said concrete pulverizer attachment comprising:

a movable lower jaw having a pivot pin mechanism and a crushing surface on which a concrete piece can be received, said crushing surface being formed with concrete waste apertures;

a set of forwardly projecting teeth mounted along a front edge of said lower edge;

a movable upper jaw having a rear end section adapted for connection to said outer end of the dipper arm and having crushing teeth mounted on a lower side of the upper jaw, said upper jaw being pivotably connected to said lower jaw by said pivot pin mechanism;

pivot means for pivotally connecting said upper jaw to a hydraulic cylinder actuator mounted on a front side of the dipper arm, whereby said upper jaw can be pivoted from an upper open position to a crushing closed position by said hydraulic cylinder actuator, said crushing teeth lying adjacent to said crushing surface in said closed position of the upper jaw; and power means for pivoting said lower jaw between a horizontally extending scooping position for picking up said concrete piece and a dumping position, said power means also being adapted to hold said lower jaw in a crushing position while said upper jaw is being pivoted by said hydraulic cylinder actuator for a concrete crushing operation.

2. A concrete pulverizing attachment according to claim 1 wherein said power means is a second hydraulic cylinder actuator connected at one operating end thereof to said lower jaw and connectible at an opposite end of the actuator to a side of said dipper arm.

3. A concrete pulverizing attachment according to claim 1 or 2 wherein said lower jaw includes a steel grate in which rows of said concrete waste apertures are formed.

4. A concrete pulverizing attachment according to claim 3 wherein said lower jaw includes two steel, elongate wear rails rigidly mounted on opposite sides of said steel grate and extending substantially perpendicular to the front edge of the lower jaw.

5. A concrete pulverizing attachment according to claim 2 wherein said lower jaw has a rearwardly extending arm provided thereon, said second hydraulic cylinder actuator includes a hydraulic cylinder and an actuator rod slidably mounted in said hydraulic cylinder and having an outer rod end, and said outer rod end is pivotally connected to a rear end section of said rearwardly extending arm.

6. A concrete pulverizing attachment according to claim 5 wherein said lower jaw including said rearwardly extending arm is equipped with steel wear bars extending along a bottom side of the lower jaw and its rearwardly extending arm.

7. A concrete pulverizing attachment according to of claim 1 wherein said crushing teeth are formed by a series of parallel teeth units arranged in a side-by-side manner on said upper jaw, each teeth unit forming a row of crushing teeth and being detachably mounted in the upper jaw.

8. A concrete pulverizing attachment according to claim 1 including a second set of forwardly projecting teeth mounted along a front edge of said upper jaw and wherein the picking teeth of each of the first mentioned and second sets are spaced apart from each other and the teeth of each of said first mentioned and second sets are mounted on their respective front edges so that the teeth of the first mentioned set are able to mesh with the teeth of the second set when said upper jaw is pivoted to a completely closed position.

9. A concrete pulverizing attachment for breaking pieces of concrete, said attachment being adapted for mounting on an outer end of a dipper arm of a power excavator, said concrete pulverizing attachment comprising:

a movable lower jaw forming a crushing upper surface on which a concrete piece can be received, having a front edge on which a set of teeth are mounted, and having a rearwardly extending, elongate arm rigidly connected to the lower jaw and adapted for orienting the lower jaw;

a movable upper jaw having first pivot means for pivotably connecting a rear end section of the upper jaw to said outer end of the dipper arm, having means for crushing said concrete piece between said upper jaw and the upper surface of said lower jaw, and having second pivot means for pivotably connecting said upper jaw to a hydraulic cylinder actuator mounted on a front side of the dipper arm, whereby during use of the attachment said upper jaw can be pivoted from an upper open position to a closed position by said hydraulic cylinder actuator, said crushing means lying adjacent said crushing upper surface in said closed position; and hydraulic power means connectible to a rear end section of said rearwardly extending elongate arm in order to pivot said lower jaw to a plurality of desired operating positions, wherein during use of the pulverizing attachment on a dipper arm, said lower jaw can be pivoted to a horizontally extending operating position in order to scoop up one or more concrete pieces to be crushed.

10. A concrete pulverizing attachment according to claim 9 wherein said hydraulic power means is a second hydraulic cylinder actuator comprising a hydraulic cylinder and an extendible actuator rod, and wherein during use of said pulverizing attachment said hydraulic cylinder is connectible at an upper closed end thereof to a rear side of the dipper arm and said actuator rod is pivotally connectible to said rear end section of the elongate arm.

11. A concrete pulverizing attachment according to claim 9 wherein said lower jaw includes a steel grate in which concrete waste apertures are formed, said steel grate forming said crushing upper surface.

12. A concrete pulverizing attachment according to claim 9 wherein said crushing means comprises a series of crushing teeth units mounted side-by-side in said upper jaw, each unit forming a row of crushing teeth.

13. A concrete pulverizing attachment according to claim 12 wherein said crushing teeth include teeth each having a convex front surface and a concave rear surface, these front and rear surfaces meeting at a rounded tip.

14. A concrete pulverizing attachment according to claim 9 wherein said set of teeth is a row of spaced-apart picking teeth that project forwardly from said front edge of the lower jaw and wherein said upper jaw also has a row of spaced-apart picking teeth mounted along a front edge of the upper jaw.

15. A concrete pulverizing attachment according to of claim 9 wherein said lower jaw, including said elongate arm, is provided with steel wear bars extending along a bottom side of the lower jaw and a bottom of the elongate arm.

* * * * *